US008863760B2

(12) United States Patent
Verbonac

(10) Patent No.: US 8,863,760 B2
(45) Date of Patent: Oct. 21, 2014

(54) APPARATUS AND METHODS FOR HAIR EXTENSIONS

(76) Inventor: Trista Verbonac, Calgary (CA)

( * ) Notice: Subject to any disclaimer, the term of this patent is extended or adjusted under 35 U.S.C. 154(b) by 93 days.

(21) Appl. No.: 13/418,551

(22) Filed: Mar. 13, 2012

(65) Prior Publication Data

US 2012/0234338 A1 Sep. 20, 2012

Related U.S. Application Data

(60) Provisional application No. 61/453,321, filed on Mar. 16, 2011.

(51) Int. Cl.
*A41G 3/00* (2006.01)
*A41G 5/00* (2006.01)

(52) U.S. Cl.
CPC ..... *A41G 5/008* (2013.01)
USPC ..... 132/201

(58) Field of Classification Search
USPC ..... 132/201, 53–56
See application file for complete search history.

(56) References Cited

U.S. PATENT DOCUMENTS

| | | | | | |
|---|---|---|---|---|---|
| 1,540,102 | A * | 6/1925 | Cohen | 132/105 |
| 1,558,931 | A * | 10/1925 | Senegas | 132/54 |
| 2,865,380 | A * | 12/1958 | Mitchell | 132/201 |
| 4,016,889 | A * | 4/1977 | Cowles | 132/56 |
| 4,176,669 | A * | 12/1979 | Levin | 132/53 |
| 2003/0075196 | A1* | 4/2003 | Fair | 132/201 |
| 2005/0103358 | A1* | 5/2005 | Sanders | 132/201 |
| 2005/0268929 | A1* | 12/2005 | Frazier | 132/53 |
| 2006/0169297 | A1* | 8/2006 | Gill et al. | 132/201 |
| 2008/0257369 | A1* | 10/2008 | Poole | 132/53 |
| 2009/0188512 | A1* | 7/2009 | Eaton | 132/54 |
| 2010/0236568 | A1* | 9/2010 | Betts | 132/201 |
| 2012/0067365 | A1* | 3/2012 | Brown | 132/201 |

* cited by examiner

*Primary Examiner* — Todd Manahan
*Assistant Examiner* — Brianne Kalach
(74) *Attorney, Agent, or Firm* — Kyle R. Satterthwaite; Ryan W. Dupuis; Ade & Company Inc.

(57) ABSTRACT

A new hair extension apparatus and method are employed to adhesively secure a hair weft at areas of exposed skin behind a wearer's ears to avoid damage to the wearer's natural hair. Two separate pieces of a flexible sheer material are each connected to a seam of the weft adjacent a respective one of two opposing ends thereof, thereby providing surfaces that face away from the seam and the strands adjacent the opposite ends of the seam for attachment of the hair weft behind the user's ears.

9 Claims, 3 Drawing Sheets

FIG. 3
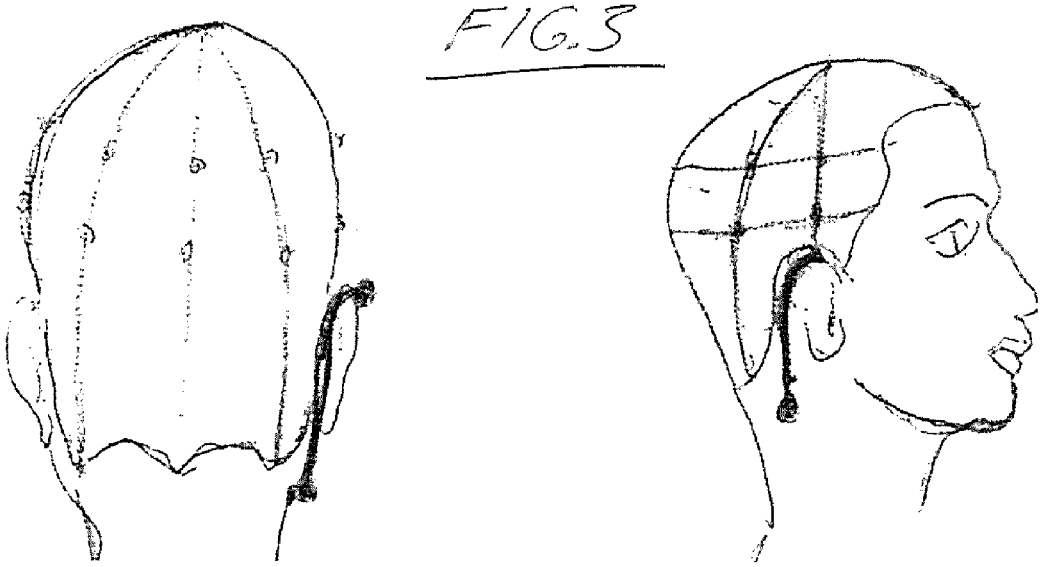
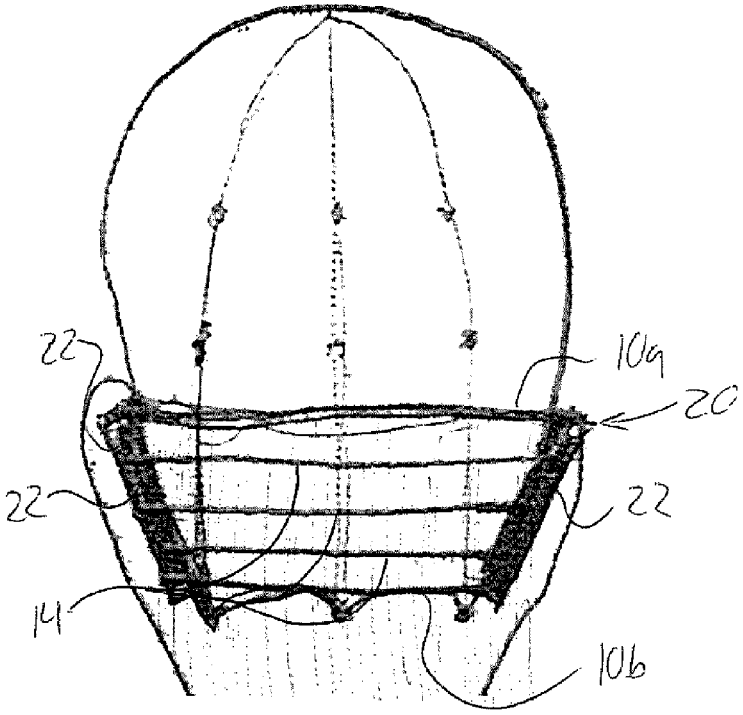
FIG. 4

APPARATUS AND METHODS FOR HAIR EXTENSIONS

CROSS REFERENCE TO RELATED APPLICATIONS

This application claims benefit under 35 U.S.C. 119(e) of U.S. Provisional Patent Application Ser. No. 61/453,321, filed Mar. 16, 2011.

FIELD OF THE INVENTION

The present invention relates to hair extensions, are more particularly to a new hair extension apparatus and method configured to adhesively secure a hair weft at areas of exposed skin behind a wearer's ears to avoid damage to the wearer's natural hair.

BACKGROUND OF THE INVENTION

Hair extensions are commonly employed to effectively thicken or lengthen a person's natural hair.

Hair extensions are typically provided in the form of a hair weft, in which single hair strands are connected to along a narrow strip-like base or seam that can be affixed to the hair or scalp of a person using a number of different methods.

For self-installation, hair wefts can be clipped into a wearer's natural hair, but can create an unnatural bulky appearance, can cause discomfort, cannot be worn while sleeping, can fall out at inappropriate times and can damage the natural hair. Also the suggested wear time is 5 hours or less.

Other methods include adhesive bonding of the hair weft to natural hair, which again can cause excessive damage to the natural hair.

Accordingly, there is a desire for hair extension products and application methods that can allow long-term wearing of hair extensions with reduced or eliminated damage to the wearer's natural hair.

SUMMARY OF THE INVENTION

According to a first aspect of the invention there is provided a hair extension apparatus comprising:

a hair weft having a seam along which hair weft strands are connected at ends thereof to extend transversely from the seam on a common side thereof; and two separate pieces of a flexible material each connected to the seam of the hair weft adjacent a respective one of two opposing ends thereof, the material of the two separate pieces being distinct from materials of the seam of the weft;

the separate pieces providing surfaces that face away from the seam and the strands adjacent the opposite ends of the seam for attachment of the hair weft behind a user's ears.

Preferably the flexible material is a sheer material.

Preferably the flexible material is lace.

Each of the two separate pieces may extend a partial distance along the seam from the respective one of the ends thereof, the two separate pieces covering less than a majority of the seam.

Each piece of flexible material may be a strip of material extending in a direction transverse to the seams of the hair wefts, which connect to each strip of material at discrete locations therealong.

There may be at least one additional hair weft extending between the two separate pieces of flexible material.

According to a second aspect of the invention there is provided a hair extension method comprising:

(a) obtaining a hair extension apparatus comprising a hair weft having a seam along which hair weft strands are connected at ends thereof to extend transversely from the seam on a common side thereof, and two separate pieces of a flexible material each connected to the seam of the hair weft adjacent a respective one of two opposing ends thereof, the material of the two separate pieces being distinct from materials of the seam of the weft; and (b) adhering each of the two pieces of flexible material to skin of the user's head behind a respective one of the ears so as to situate the seam in a position extending across the user's head behind the ears, thereby hanging the hair weft strands at a back of the user's head.

Step (b) may comprise first lifting natural hair on a user's head upward from space between ears of the user around the back of the user's head so that the seam is then positioned below lifted natural hair, and wherein additional step (c) comprises releasing the lifted natural hair to hang over the seam.

The method may involve attaching the hair extension apparatus to the user's head only behind the ears at the two pieces of flexible material.

Alternatively, step (b) may comprise first creating a cornrow of natural hair between the ears at a back of user's head, and wherein additional step (c) comprises sewing the hair weft to the corn row.

Step (a) preferably first comprises using a measured distance between the ears around the back of the user's head to determine a suitable hair weft seam length for the user.

Step (a) may comprise, after having measured the distance between the ears, selecting the hair extension apparatus from different available apparatuses having different hair weft seam lengths.

Alternatively, step (a) may comprise, after having measured the distance between the ears, producing the hair extension apparatus by cutting an initially longer-seamed hair weft to better match the determined suitable hair weft seam length and then attaching the two pieces of flexible material to the initially longer-seamed hair weft.

Step (b) preferably comprises adhering the two pieces of flexible material one at a time, and applying pressure on a first of the two pieces against the skin for a period of time before adhering the other of the two pieces, in which case step (b) preferably comprises pulling the seam of the weft against the back of the user's head between the adhering of the two pieces of flexible material to the skin.

According to a third aspect of the invention there is provided a method of producing a hair extension apparatus comprising:

obtaining a hair weft having a seam along which hair weft strands are connected at ends thereof to extend transversely from the seam on a common side thereof; and attaching two separate pieces of a flexible material to the seam of the hair weft, each adjacent a respective one of two opposing of the seam, the material of the two separate pieces being distinct from materials of the seam of the weft;

whereby the separate pieces provide surfaces that face away from the seam and the strands adjacent the opposite ends of the seam for attachment of the hair weft behind a user's ears.

BRIEF DESCRIPTION OF THE DRAWINGS

In the accompanying drawings, which illustrate a exemplary embodiments of the present invention:

FIG. 3 is a schematic illustration demonstrating a nape to ear measurement taken in a method of attaching the hair extension apparatus of FIG. 2 to a wearer.

FIG. 4 is a schematic illustration of the hair extension apparatus of FIG. 2 applied at the back of a wearer's head.

DETAILED DESCRIPTION

Figure 1:
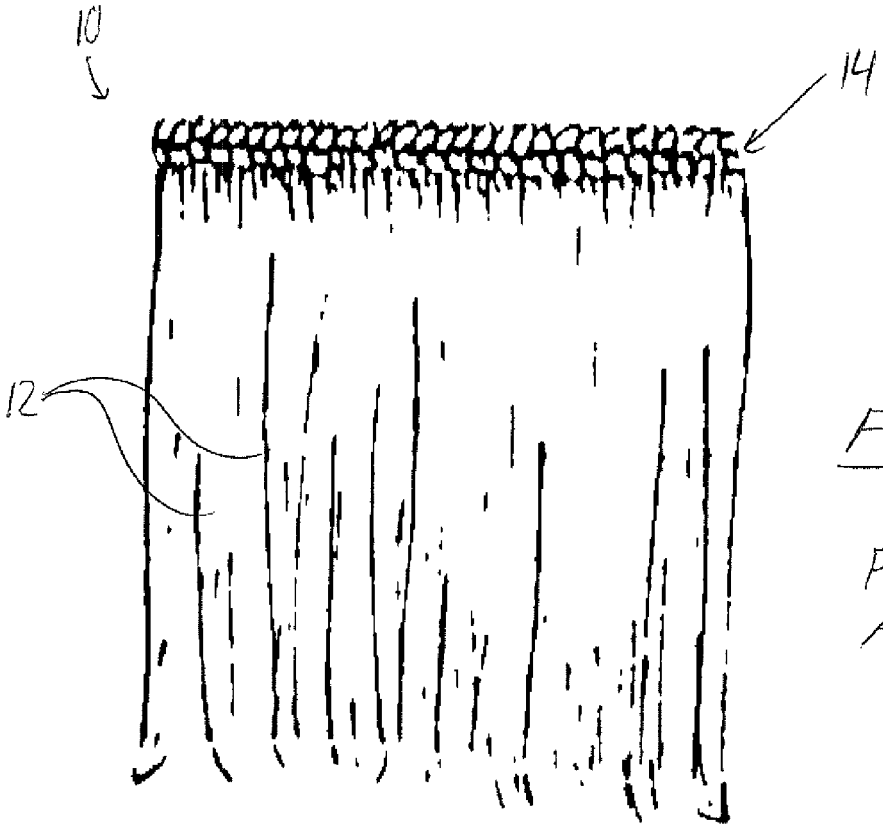
FIG. 1 PRIOR ART
FIG. 1 is a schematic illustration of a conventional hair weft.

The present invention adds additional features to a conventional hair weft 10, like that shown in FIG. 1, in order to provide a new way of attaching the hair weft to the head of the wearer to reduce or completely avoid damage to the wearer's natural hair. The conventional hair weft 10 is a curtain-like strip of hair, in which individual strands 12 of natural or synthetic hair are suspended from a seam 14 spanning across a top end of the weft 10 so as to hang to one side of the seam over the full length thereof. The interconnection of the strands at this seam may be accomplished by sewing the strands to a strip of fine base material, or one or more lengths of string, crossing the strands.

Figure 2:
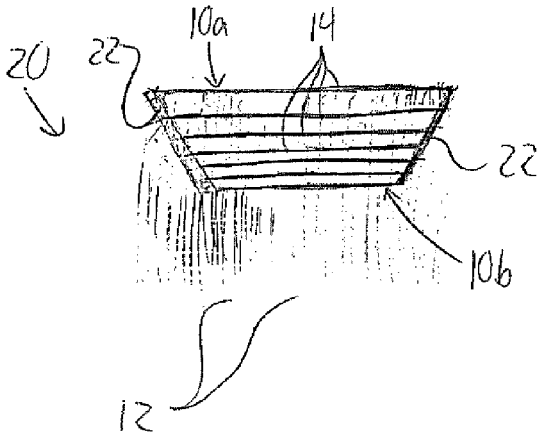
FIG. 2 is a schematic illustration of a hair extension apparatus of the present invention.

FIG. 2 shows a hair extension apparatus 20 according to one embodiment of the present invention. The apparatus features two strips 22 of a sheer lace material disposed at its opposing sides, and a plurality of conventional hair wefts 10 suspended between the two strips 22. Each hair weft 10 has the two ends of its seam respectively attached to the two strips 22 so that the seam 14 extends laterally between the two strips 22 to hang the strands 12 of hair downward from the seam 14. The seam length of the hair wefts 10 decreases moving down the apparatus, from a longest-seam weft 10*a* connected to the strips 22 adjacent the upper ends thereof to a shortest-seam weft 10*b* connected to the strips 22 adjacent the bottom ends thereof. The strips 22 are therefore not parallel, but instead are obliquely angled relative to one another to slope symmetrically toward one another from their top to bottom ends. Accordingly, the strips 22 cooperate with the seams of the top and bottom wefts 10*a*, 10*b* to form an inverted trapezoidal shape. Due to the greater seam-length of the top weft 10*a*, the strands thereof hang downward over the lower portions of the strips 22.

The strips 22 extend beneath the wefts 10 so that the underside of each strip 22, facing opposite the strip's outer surface where the wefts 10 are attached, is left open to form a flexible surface to be conformingly placed against a user's skin for adhesive bonding thereto. The sheer lace of the strips is a fine mesh material used in conventional wigs to form a hair-carrying base layer that is not visibly prominent, thus being undetectable or substantially unnoticeable to the average observer. Full lace wigs use such material for the entire base, while lace front wigs employ the lace material only at the front of the wig where the hairline is most visible, and use a more durable material for the remainder of the base. The present invention makes use the lace material only at opposing of the hair wefts, where the primarily or sole attachment of the weft to the user's head is to take place, as described herein further below. The attachment of the lace pieces to the hair weft may be achieved by sewing, gluing, taping or other suitable fastening or bonding techniques.

The apparatus can be produced with different numbers of hair wefts. For example, a single-weft apparatus features a single hair weft having two pieces of lace material attached to its seam adjacent its two ends. In the illustrated multi-weft embodiment, each strip 22 extends transversely across the ends of the weft seams in order to make connection to each weft. In a single-weft embodiment, a smaller piece of lace material may be used, which if still selected to have an elongated strip-like shape, may extend a short distance along the seam from the respective end thereof thereby maximizing the obscuring of the strip when the apparatus is installed, as the strip will reside beneath the seam of the single weft.

The process of applying a hair extension apparatus of the present invention begins with two measurements of the wearer's head. One measurement is taken around the back of head from one ear to the other, and the other measurement, as denoted in FIG. 3, is taken from the nape of the hairline to the top of the ear. The first measurement is used to determine how the long the seam of an appropriate hair weft should be in order to fully span across the back of the wearer's head, and the second measurement is used to determine a maximum length of lace material that can be used to later attach the weft to the head at an area of skin behind the ear without extending up from behind the ear or down past the nape of the hairline. The measurements don't need to be exact, but are used to determine the size of apparatus required. Apparatuses may be pre-fabricated to have various dimensions (weft seam length, hair length), hair colors, and hair densities. The wearer or other person fitting the wearer can then select an appropriate product to best suit their needs. Alternatively, the wearer or other person may product a customized apparatus based on their requirements, for example by selecting one or more wefts of suitable seam-length (or cutting down longer-seamed wefts to the suitable length) based on the measured ear-to-ear distance of the wearer. Having selected or produced a suitable length weft in this manner, the lace pieces can then be fixed onto the weft at the opposite ends of the seam, resulting in an apparatus that is ready for attachment to the wearer.

After choosing or producing an apparatus with the proper fit, color, length and density the apparatus is then fitted to the wearer's head to determine if any further adjustments (cutting) is required.

In one application method, once the apparatus is deemed ready for application, the process begins by lifting all natural out of the way from the area at the back of the head between the ears, and to maintain this lifted condition of the hair, for example by clipping the lifted hair up above the ears. Next, one cleans the exposed area of skin left behind each ear outside the hairline curving therearound so that this skin area is free of natural oils and any contaminants. Also, the fingers of the installer need to similarly be clean so as not to contaminate the lace material of the apparatus that will be later adhered to this area of skin. Peroxide is an example of a preferable cleaning agent, as soaps can leave oils behind. Next, a lace wig/skin adhesive is applied to the area behind each ear. Depending on the adhesive being used, one may have to wait a short period of time for the adhesive to become tacky before continuing to the next step of the process. Double-sided lace wig/skin tape is then applied to the areas behind the ears where the lace wig/skin adhesive was previously applied. The tape may be cut down as needed before application in order to fit within the available hair-free space behind the ear. Next, the covering layer on the exposed side of the double-sided adhesive tape is removed. Optionally, a liquid adhesive can be applied to the exposed side of the adhesive tape for extra hold. Next, the free inner surface of a respective one of the lace pieces of the apparatus is applied to the now-exposed outer side of the double-sided adhesive tape. Pressure is applied and held on the apparatus over the already applied lace piece, preferably for several minutes, to ensure thorough adhesion between the lace and skin-applied adhesive. While holding the first side of the apparatus (i.e. the ends of the wefts with the already adhered-in-place lace piece), the rest of the apparatus is gently pulled around the rear of the wearer's head toward the other ear, to snugly extend the seam of the weft around the back of the head and attach the second lace piece to the exposed adhesive tape behind the second ear. The apparatus is thus secured at the back of the head, with the seams of the wefts spanning between the ears to hang the hair strands of the wefts over the back of the head, as shown in FIG. 4. Pressure is then applied at both sides of the apparatus (i.e. against the adhesive-coated area behind the ear), preferably for at least several more minutes. The lifted natural hair can then be let down to hang partially over the now-adorned apparatus, thereby covering up at least the top seam thereof. Prior to styling and possible cutting of the freshly extended hair, it may be preferable to wait 1-hour for the adhesive to fully bond the lace to the skin. The length of this suitable waiting time may be dependent on the type of adhesive used. The newly extended hair can then be cut and styled as desired.

Figure 5:
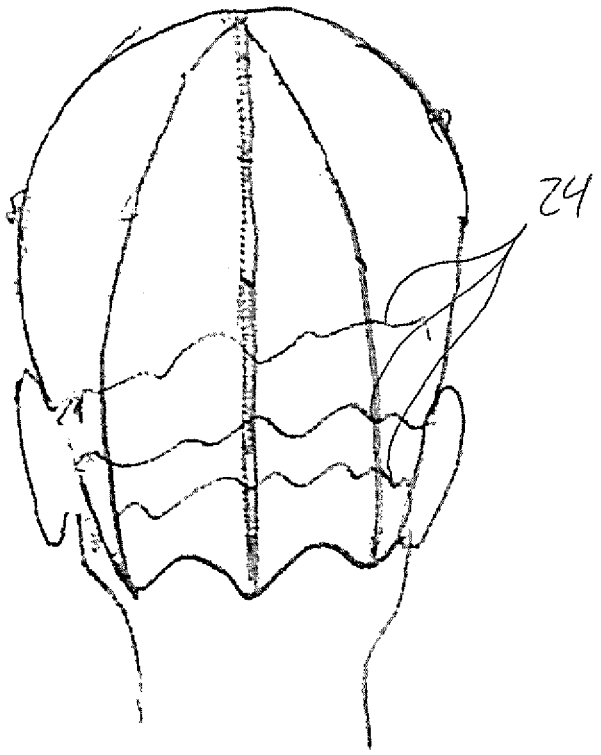
FIG. 5 is a schematic illustration demonstrating how cornrows may be employed to further secure the hair extension apparatus to the head of the wearer.

In a second application method, instead of lifting all of the natural hair up to accommodate the apparatus, one instead lifts some of the hair at the back of the head and uses the remainder to creates one or more corn-rows 24 across the back of the head in the area thereof between the ears, as shown in FIG. 5. The same process as the first method is then followed up to the point where both lace pieces have been adhered in place by application of suitable pressure against the adhesive-coated skin, which is performed at such locations as to position the seam of the hair weft on a respective corn row spanning across the back of the head. At this point, the seams of one or more of the wefts adhered and positioned in this manner are sewn into the one or more corn rows between the two lace pieces now attached to the wearer's head, thereby further securing the apparatus in place. The previously raised natural hair above the top weft of the apparatus is then released to hang downward over the seam of the apparatus' uppermost weft in order to conceal it and any cornrow to which it is has been sewn. The styling, and any desired cutting, can then take place like in the first application method, again preferably after giving the adhesive bond time to strengthen.

A third application method, instead of lifting all of the natural hair up to accommodate the apparatus like in the first method or creating corn rows like in the second method, one instead lifts some of the hair at the back of the head so as to form a horizontal part in the natural hair across the back of the head in the area thereof between the ears, as shown in FIG. 5. Keeping the hair above the part lifted, the same process as the first method is then followed up to the point where adhesive has been applied behind both hears. Rather than applying the first lace to once such area, instead hair adhesive or tape, or a combination of both, is similarly applied over the natural hair at the horizontal part. At this point, the two lace pieces of the hair weft are adhered in place behind the ears as in the first method, with the seam of the weft being laid over the adhesively-coated horizontal part of the natural hair while the seam weft is laid out across the back of the head to position the second lace piece of the hair weft behind the second ear after having secured the first lace piece in place behind the first ear. In the same way that pressure is applied at the lace pieces to encourage bonding to the skin, pressure may be applied to the remainder of the seam between the lace piece to encourage bonding of this intermediate portion of the seam to the adhesive lying beneath the seam at the horizontal parting of the natural hair.

A fourth application method is the same as the third up to the point where adhesive has been applied behind both ears and to the horizontal part in the natural hair in any order. In this method, rather than adhering the weft behind the ears first, the intermediate portion of the seam is instead applied over the adhesively coated part in the natural hair, and pressure is applied and maintained to encourage adhesive bonding of this intermediate portion to the wearer's head. Then, one at a time, each lace piece of the weft is pulled up into place behind a respective ear, where pressure is applied to bond to the lace piece to the adhesive previously applied to the skin behind the ear. In a variation of this method, adhesive may be applied behind the ear after the bonding of the intermediate portion of weft at the horizontal part in the natural hair.

The present invention avoids or reduces hair damage associated with prior art hair extensions that attach to the hair by using available hair-free skin area that naturally occurs behind the ear outside the hairline as the primary or sole attachment points to the wearer's head. The use of lace wig base material at each end of a hair weft allows a greater bonding area over this patch of free skin than would be available by directly bonding the weft itself to the skin, as the lace piece can be greater in size than the width of the weft seams without dramatically increasing the visibility of the weft due to the semi-transparent or sheer nature of the lace mesh. Use of the lace only at the ends of the weft(s), where the attachment is to take place, avoids the presence of such material at locations between these end pieces so as to avoid any wear or damage this material may cause as a result of rubbing against the wearer's natural hair in its proximity. While the apparatus may include additional attachment to the wearer's natural hair between the end lace pieces, this still offers a benefit as the bonding to the skin behind the ears furthers the attachment strength to the wearer.

While the described methods of application include the use of both tape and a further adhesive for maximum bonding, one could instead use only one of the two adhesive types. Also, it may be possible to use flexible materials other than lace for the attachment pieces to be bonded to the skin, but the lace is a known material that presents a suitable option based on its prior use in wigs to provide a skin-bondable surface while being difficult to visually detect.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A hair extension method comprising:

(a) obtaining a hair extension apparatus comprising a hair weft having a seam along which hair weft strands are connected at ends thereof to extend transversely from the seam on a common side thereof, and two separate pieces of a flexible material each connected to the seam of the hair weft adjacent a respective one of two opposing ends thereof, the material of the two separate pieces being distinct from materials of the seam of the weft; and (b) adhering each of the two pieces of flexible material to skin of the user's head behind a respective one of the ears and outside of the hairline of the user at an area where said hairline curves around said respective one of the ears so as to situate the seam in a position lying across the user's head behind the ears and reaching between the two areas where the hairline curves around the ears, thereby hanging the hair weft strands at a back of the user's head.

2. The method of claim 1 wherein step (b) comprises first lifting natural hair on a user's head upward from space between ears of the user around the back of the user's head so that the seam is then positioned below lifted natural hair, and wherein additional step (c) comprises releasing the lifted natural hair to hang over the seam.

3. The method of claim 1 comprising attaching the hair extension apparatus to the user's head only behind the ears at the two pieces of flexible material.

4. The method of claim 1 wherein step (b) comprises first creating a cornrow of natural hair between the ears at a back of user's head, and wherein additional step (c) comprises sewing the hair weft to the corn row.

5. The method of claim 1 wherein step (a) first comprises using a measured distance between the ears around the back of the user's head to determine a suitable hair weft seam length for the user.

6. The method of claim 5 wherein step (a) comprises, after having measured the distance between the ears, selecting the hair extension apparatus from different available apparatuses having different hair weft seam lengths.

7. The method of claim 5 wherein step (a) comprises, after having measured the distance between the ears, producing the hair extension apparatus by cutting an initially longer-seamed hair weft to better match the determined suitable hair weft seam length and then attaching the two pieces of flexible material to the initially longer-seamed hair weft.

8. The method of claim 1 wherein step (b) comprises adhering the two pieces of flexible material one at a time, and applying pressure on a first of the two pieces against the skin for a period of time before adhering the other of the two pieces.

9. The method of claim 8 wherein step (b) comprises pulling the seam of the weft against the back of the user's head between the adhering of the two pieces of flexible material to the skin.

* * * * *